US008517624B2

(12) United States Patent
Warmus

(10) Patent No.: US 8,517,624 B2
(45) Date of Patent: Aug. 27, 2013

(54) BINDER APPARATUS

(75) Inventor: James Warmus, La Grange, IL (US)

(73) Assignee: R.R. Donnelly & Sons, Chicago, IL (US)

( * ) Notice: Subject to any disclaimer, the term of this patent is extended or adjusted under 35 U.S.C. 154(b) by 276 days.

(21) Appl. No.: 12/945,370

(22) Filed: Nov. 12, 2010

(65) Prior Publication Data

US 2012/0121317 A1 May 17, 2012

(51) Int. Cl.
*B42F 3/04* (2006.01)
*B42F 13/20* (2006.01)

(52) U.S. Cl.
USPC ..... 402/30; 402/31; 402/36; 402/37; 402/38; 402/41

(58) Field of Classification Search
USPC ..... 402/29–31, 36–38, 41
See application file for complete search history.

(56) References Cited

U.S. PATENT DOCUMENTS

| | | | | |
|---|---|---|---|---|
| 1,439,367 | A * | 12/1922 | Krag | 402/41 |
| 1,440,394 | A * | 1/1923 | Krag | 402/41 |
| 2,013,416 | A * | 9/1935 | McClure | 402/38 |
| 4,566,817 | A | 1/1986 | Barrett, Jr. | |
| 4,571,108 | A | 2/1986 | Vogl | |
| 4,919,557 | A | 4/1990 | Podosek | |
| 5,975,785 | A | 11/1999 | Chan | |
| 6,142,697 | A | 11/2000 | Williams | |
| 6,276,862 | B1 * | 8/2001 | Snyder et al. | 402/41 |
| 6,840,695 | B2 | 1/2005 | Horn | |
| 6,916,134 | B2 | 7/2005 | Wong | |
| 7,275,886 | B2 | 10/2007 | Cheng | |
| 7,534,064 | B2 | 5/2009 | Cheng | |
| 7,648,302 | B2 | 1/2010 | Zhang et al. | |
| 7,661,898 | B2 | 2/2010 | Ng et al. | |
| 7,661,899 | B2 | 2/2010 | Lin | |
| 7,665,926 | B2 | 2/2010 | Cheng | |
| 7,704,005 | B2 | 4/2010 | Lin | |
| 7,726,897 | B2 | 6/2010 | To et al. | |
| 7,731,441 | B2 | 6/2010 | Ng et al. | |
| 7,744,300 | B2 | 6/2010 | Cheng et al. | |
| 7,758,271 | B2 | 7/2010 | Cheng | |
| 7,828,491 | B2 | 11/2010 | Cheng | |

(Continued)

FOREIGN PATENT DOCUMENTS

| | | |
|---|---|---|
| GB | 2292343 | 2/1996 |
| JP | 1299095 | 12/1989 |
| JP | 10217662 | 8/1998 |

*Primary Examiner* — Kyle Grabowski
(74) *Attorney, Agent, or Firm* — Hanley, Flight and Zimmerman, LLC

(57) ABSTRACT

Binder apparatus are described. An example binder apparatus includes a housing and a first carrier rail having a first longitudinal edge and a second longitudinal edge. The first carrier rail defining a notch adjacent the second longitudinal edge. The housing biasing the first carrier rail by engaging the first longitudinal edge. The binder apparatus includes a second carrier rail having a third longitudinal edge and a fourth longitudinal edge. The housing biasing the second carrier rail by engaging the third longitudinal edge. The second longitudinal edge hingably engaging the fourth longitudinal edge, the notch defining an opening having a first edge and a second edge opposite the first edge. The binder includes a slider having a control element extending therefrom. The control element comprising a first control surface and a second control surface. The first control surface to engage the first edge to urge the first and second carrier rails to an open position, the second control surface to engage the second edge to urge the first and second carrier rails to a closed position.

18 Claims, 13 Drawing Sheets

(56) References Cited

U.S. PATENT DOCUMENTS

2005/0201818 A1 9/2005 Cheng
2008/0075527 A1 3/2008 Pi et al.
2009/0060631 A1 3/2009 To et al.
2009/0274508 A1 11/2009 Zhang et al.
2010/0232867 A1 9/2010 Ng et al.

* cited by examiner

BINDER APPARATUS

FIELD OF THE DISCLOSURE

This patent relates to binders and, more specifically, to binder apparatus.

BACKGROUND

Binders are used to store loose leaf pages, documents, other materials, etc.

DETAILED DESCRIPTION

Figure 1:
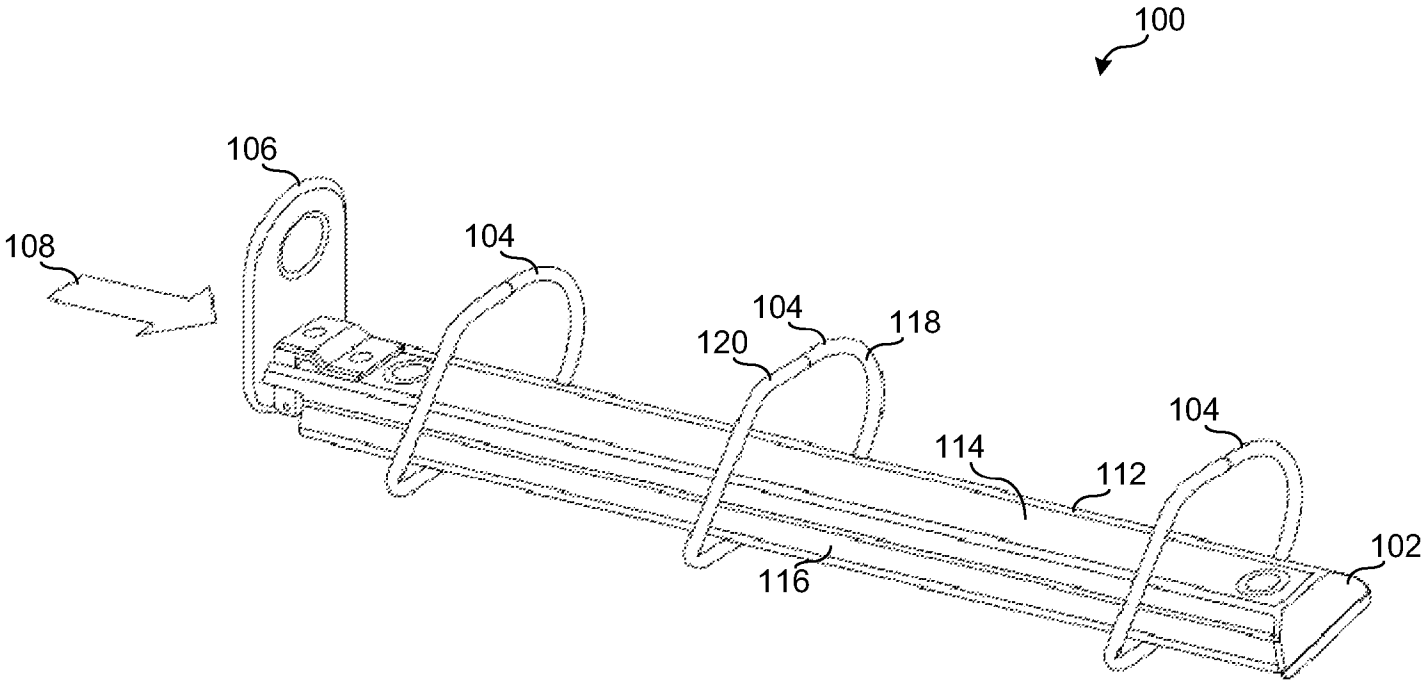
FIGS. 1-6 depict different views of an example binder apparatus.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The examples described herein relate to binder apparatus that enable closure members to be relatively easily transitioned and/or secured in either the open position or the closed position. More specifically, the examples described herein enable carrier rails of binder apparatus to be locked in and/or transitioned between either the open and/or closed positions using, for example, one or more control elements. In contrast to known binders, the examples described herein enable closure members coupled to the carrier rails to be either opened and/or closed without the use of spring mechanisms and/or delay mechanisms.

In some examples, the one or more control elements extend substantially perpendicularly from a longitudinally movable slider and toward an inner surface of a binder housing. In such examples, if the slider is moved in a direction to open the closure members, the control elements may be forced under the carrier rails against a closing force exerted by the binder housing to raise the middle of the carrier rails and position the closure members in the open position. If the slider is moved in a direction to close the closure members, the control elements may be forced over the carrier rails against the closing force exerted by the binder housing to lower the middle of the carrier rails and position the closure members in the closed position. In the closed position, the closure members may form a circular closure, a D-shaped closure, etc.

In other examples, one or more control elements extend substantially perpendicularly from a longitudinally movable slider and away an inner surface of a binder housing. In such examples, the one or more control elements may face a different direction (e.g., a different end of the binder housing) than when the control elements are facing the inner surface of the binder housing. Thus, if the slider is moved in a direction to open the closure members, the control elements may be forced under the carrier rails and if the slider is moved in a direction to close the closure members, the control elements may be forced over the carrier rails.

The control elements may include control surfaces that interact with the carrier rails of the binder apparatus as the slider is being moved relative thereto. In some examples, each of the control surfaces includes one or more tapered, sloped and/or stepped surfaces that assist in transitioning and/or securing the carrier rails in either the open or closed position. For example, a first tapered surface of one of the control surfaces may transition the carrier rails from the open position to the closed position and a second tapered or flat surface may engage the carrier rails once positioned in the closed position to ensure that the carrier rails and/or the control elements do not inadvertently move from the closed position. In some examples, the second tapered or flat surface may include a nub that is received by the binder housing and/or the carrier rails to further secure the carrier rails and/or the control elements in the closed position. Additionally or alternatively, a third tapered surface of another one of the control surfaces may transition the carrier rails from the closed position to the open position and a fourth tapered or flat surface may engage the carrier rails once positioned in the open position to ensure that the carrier rails and/or the control elements do not inadvertently move from the open position. In some examples, the fourth tapered or flat surface may include a nub that is received by the binder housing and/or the carrier rails to further secure the carrier rails and/or the control elements in the closed position.

In some examples, as a lever assembly moves the slider to a first or open position, a first control surface of the control elements engages edges and/or surfaces of the carrier rails. The interaction between the first control surface and the carrier rails moves the carrier rails and the closure members to the open position. Once in the open position, a surface and/or step of the first control surface may be positioned such to substantially prevent the carrier rails and/or the closure members from moving from the open position.

In some examples, as the lever assembly moves the slider to a second or closed position, a second control surface of the control elements engages edges and/or surfaces of the carrier rails. The interaction between the second control surface and the carrier rails moves the carrier rails and the closure members coupled thereto to the closed position. Once in the closed position, a surface and/or step of the second control surface may be positioned such to substantially prevent the carrier rails and/or the closure members from moving from the closed position.

Figure 2:
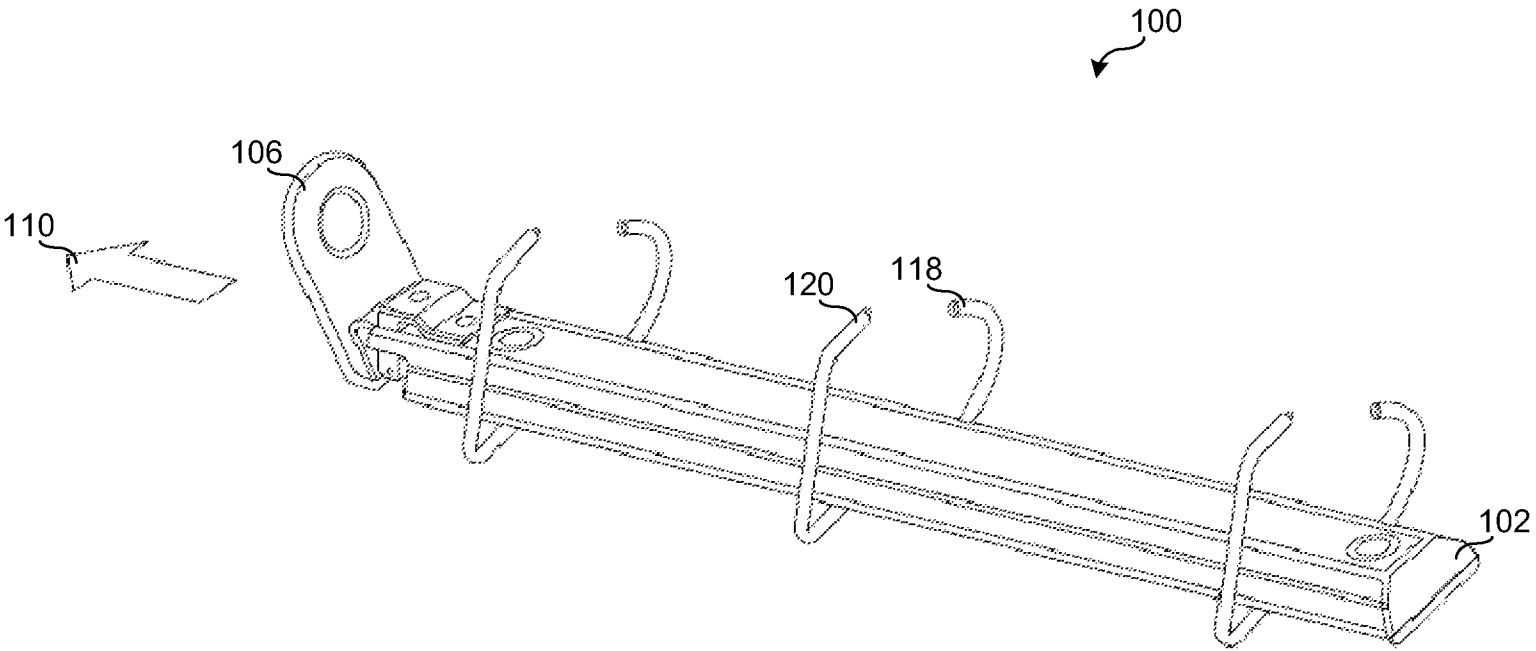

FIGS. 1 and 2 depict an example binder apparatus 100 that may be used to store loose leaf pages, documents, other materials, etc. The binder 100 may include a housing 102, one or more associated closure members 104 and a lever or actuating assembly 106. To open and/or close the associated closure members 104, the lever assembly 106 may be actuated in a direction generally represented by arrows 108 and/or 110. Specifically, to open the associated closure members 104, the lever assembly 106 is moved in a direction generally represented by arrow 110 and, to close the associated closure members 104, the lever assembly 106 is moved in a direction generally represented by arrow 108. However, the lever assembly 106 may be differently configured to open and/or close the associated closure members 104.

The housing 102 includes a first side or portion 112, a second side or portion 114 and a third side or portion 116. The second side 114 is coupled to and positioned between the first side 112 and the third side 116. Each of the associated closure members 104 includes a first portion or section 118 and a second portion or section 120. The first and second portions 118 and 120 engage and/or interact to form a closure that enables documents, etc. to be stored within the binder 100. In some examples, the closure members 104 may be different then depicted in FIGS. 1 and 2. For example, the first and/or second portions 118 and/or 120 may be differently curved, may both be similar to one another, may form a ring, etc.

Figure 3:
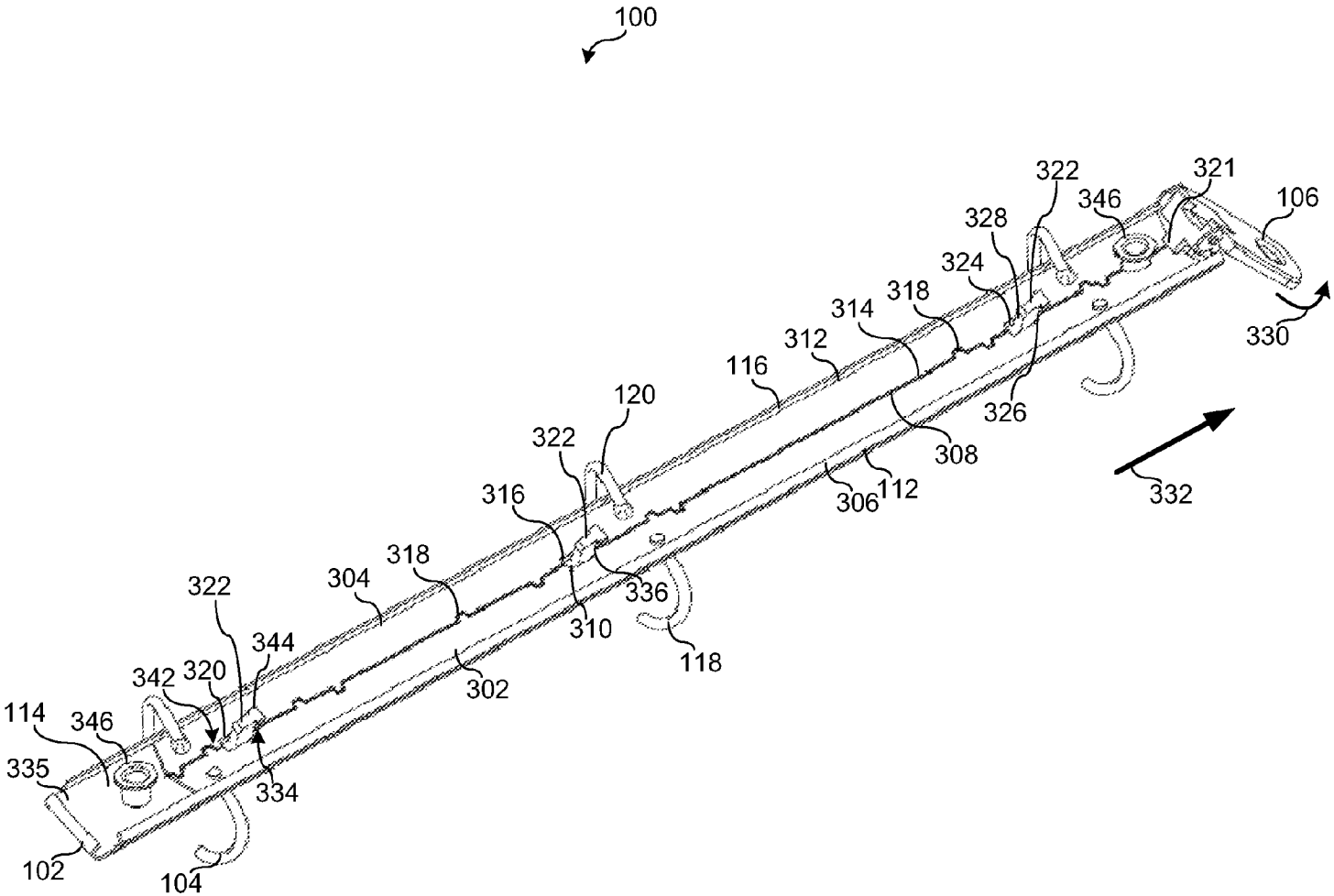
Figure 4:
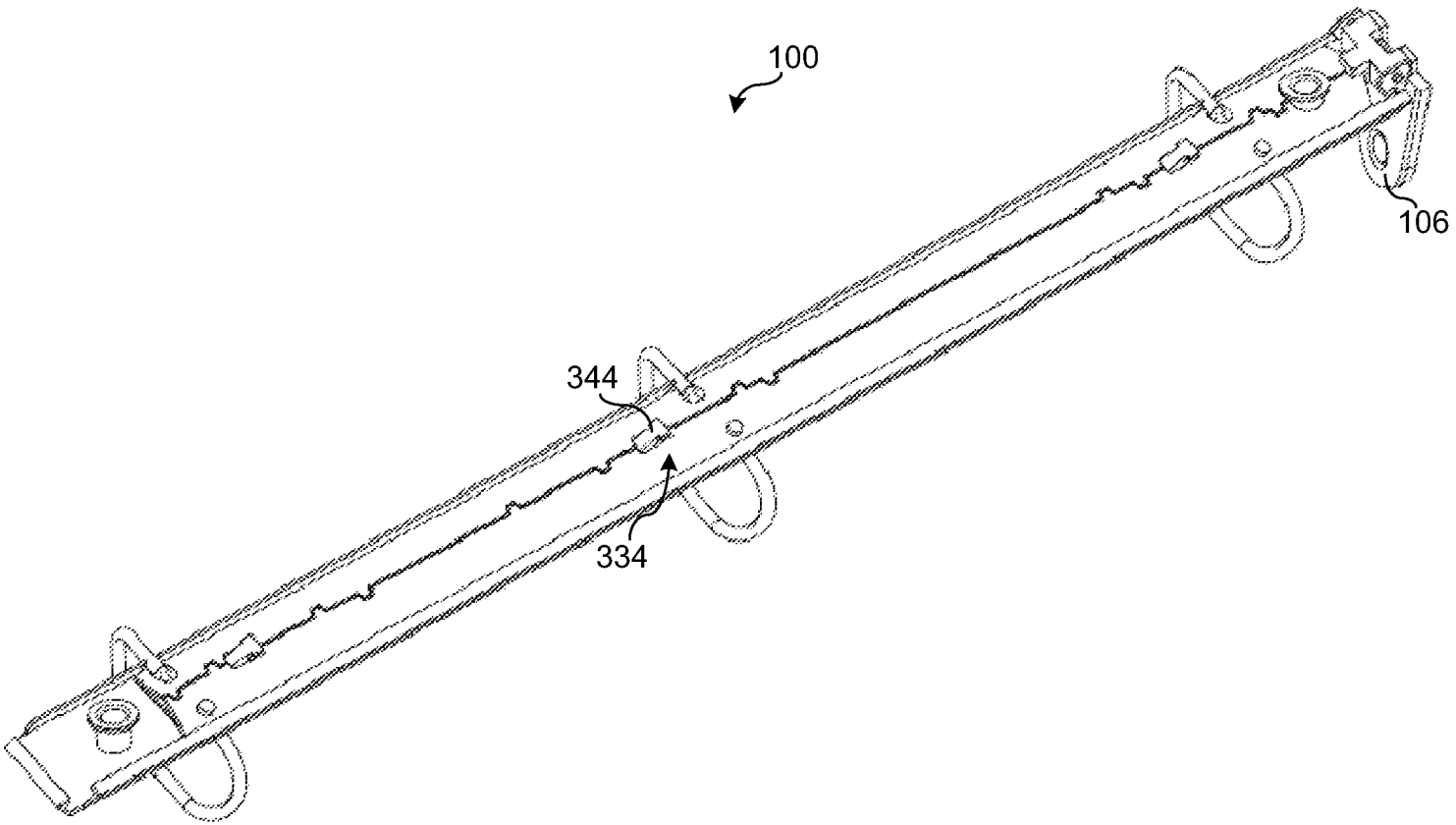

FIGS. 3 and 4 depict alternative views of the example binder 100. The binder 100 includes a first carrier rail 302 and a second carrier rail 304 to which the first and second portions 118 and 120 of the associated closure members 104 are respectively coupled. The first carrier rail 302 includes a first longitudinal edge 306 biased by the first side 112 of the housing 102 and a second longitudinal edge 308 including a plurality of notches 310. The second carrier rail 304 includes a third longitudinal edge 312 biased by the third side 116 of the housing 102 and a fourth longitudinal edge 314 including a plurality of notches 316. In some examples, only one of the first and/or the second carrier rails 302 and 304 may be provided with the notches 310 and/or 316. The first and third sides 112 and 116 may have a cross-sectional shape (e.g., curved, edges, etc.) to at least partially retain the carrier rails 302 and 304 in the housing 102. The second longitudinal edge 308 and the fourth longitudinal edge 314 may be hingably coupled via a plurality of corresponding tabs and/or notches 318, for example.

The binder 100 includes a slider 320 defining an aperture 702 (FIG. 7) to enable the lever assembly 106 to be operatively coupled thereto. The coupling between the lever assembly 106 and the slider 320 enables movement of the lever assembly 106 to correspondingly move the slider 320. The slider 320 may be referred to as a push rod, a travel bar, a movable member, a carrier, a traveler, etc. and may have any other suitable shape and/or structure than depicted. In some examples, the lever assembly 106 may include a portion or beak 321 defining a groove into which ends of the carrier rails 302 and 304 may be at least partially positioned. The interaction between the beak 321 and the carrier rails 302 may transition and/or assist in transitioning the carrier rails 302 and 304 between the open and closed positions. In some examples, the interaction between the beak 321 and the carrier rails 302 may secure (e.g., lock) and/or assist in securing the carrier rails 302 and 304 in the open and/or closed positions.

In this example, the slider 320 includes a plurality of control elements 322 extending therefrom and at least partially through openings 324 defined by the aligned notches 310 and 316. While the example slider 320 includes three control elements 322, the example slider 320 may include any other number (e.g., 1, 2, 3, 4, etc.) of control elements 322 that may be evenly or unevenly spaced along the slider 320, for example.

The plurality of control elements 322 interact with the carrier rails 302 and 304 to urge, transition and/or secure the carrier rails 302 and 304 in a first or open position and/or a second or closed position. In some examples, the plurality of control elements 322 extend substantially perpendicularly from the slider 320. In some examples, one of the plurality of control elements 322 is positioned adjacent to each of the associated closure members 104. Such an approach of positioning one of the control elements 322 adjacent to each of the associated closure members 104 and/or providing the binder 100 with the control elements 322 may decrease the likelihood that the binder 100 will inadvertently open and/or close if the binder 100 is, for example, dropped off of a table.

In some examples, each of the plurality of control elements 322 includes a first control surface 326 and a second control surface 328 opposite the first control surface 326. The first and second control surfaces 326 and 328 may urge, transition and/or secure the carrier rails 302 and 304 in and/or toward a particular position depending on the position of the control elements 322 relative to the carrier rails 302 and 304.

For example, as the lever assembly 106 is moved in a direction generally represented by arrow 330, the slider 320 is moved in a direction generally represented by arrow 332 and the first control surface 326 engages respective surfaces and/or edges 334 of the carrier rails 302 and 304 adjacent to and/or defining the openings 324. The respective surfaces 334 may face away from an interior or inner surface 335 of the housing 102, for example. The engagement and/or interaction between the first control surface 326 and the respective surfaces 334 move and/or transition the carrier rails 302 and 304 and, thus, the associated closure members 104 to the open position as the slider 320 and the control elements 322 are being moved relative thereto. In some examples, the first control surface 326 includes one or more curved and/or sloped surfaces that transition the carrier rails 302 and 304 from the closed position to the open position as the slider 320 is being moved from the second position to the first position. However, in other examples, the beak 321 of the lever assembly 106 may transition the carrier rails 302 and 304 between the open and/or closed positions and, thus, the control surfaces 326 and/or 328 may be different and/or may not transition and/or assist in transitioning the carrier rails 302 and/or 304. In some examples, the first control surface 326 includes a notch, step or different curvature or slope 336 to be positioned over the respective surfaces 334 when the associated closure members 104 are fully open. The interaction between the step 336 and the respective surfaces 334 may secure the carrier rails 302 and 304 and the associated closure members 104 in the open position. Additionally or alternatively, the engagement between the step 336 and the carrier rails 302 and 304 substantially ensures that the carrier rails 302 and 304 and/or the control elements 322 do not move and/or slip from the open position.

In some examples, as the lever assembly 106 is moved in a direction generally opposite that of arrow 330, the slider 320 is moved in a direction generally opposite that of arrow 332 and the second control surface 328 engages respective surfaces and/or edges 342 adjacent to and/or defining the openings 324. The surfaces 342 may be opposite the surfaces 334. The respective surfaces 342 may face toward the interior surface 335 of the housing 102, for example. The engagement between the second control surface 328 and the respective surfaces 342 move and/or transition the carrier rails 302 and 304 and, thus, the associated closure members 104 to the closed position as the slider 320 and the control elements 322 are being moved relative thereto. In some examples, the second control surface 328 includes one or more curved surfaces and/or sloped surfaces that transition the carrier rails 302 and 304 from the open position to the closed position as the slider 320 is being moved from the first position to the second position. In some examples, in the closed position, the control elements 322 are substantially positioned between the carrier rails 302 and 304 and the housing 102, thereby securing the carrier rails 302 and 304 and the associated closure members 104 in the closed position. For example, in the closed position, a slightly tapered and/or flat surface of the control elements 322 may engage the surfaces 342 of the carrier rails 302 and 304. The engagement between the surfaces in the closed position substantially ensures that the closure members 104 remain in the closed position and that the control elements 322 and/or the slider 320 do not inadvertently move and/or slip from the closed position.

In some examples, in the closed position, an extension 344 of the control elements 322 at least partially extends over the respective surfaces 334 to substantially ensure alignment of the control elements 322 with the carrier rails 302 and 304 when the control elements 322 are moved relative thereto. For example, the extension 344 extending over the respective surfaces 334 substantially ensures that the control elements 322 do not bind on the carrier rails 302 and/or 304 as the control elements 322 are moved from the second position to the first position. The extension 344 and/or portions of the control elements 322 may be tapered to enable a relatively smooth interaction between the carrier rails 302 and 304 and the control elements 322 as the control elements 322 are being moved to open or close the binder apparatus 100.

The housing 102 may include one or more posts 346 extending from the second side 114 of the housing 102. In some examples, the slider 320 defines a slot 704 (FIG. 7) through which the post 346 extends. The interaction between the slot 704 and the post 346 may at least partially guide the movement of the slider 320 as the lever assembly 106 moves the slider 320 between the open and closed positions.

Figure 5:
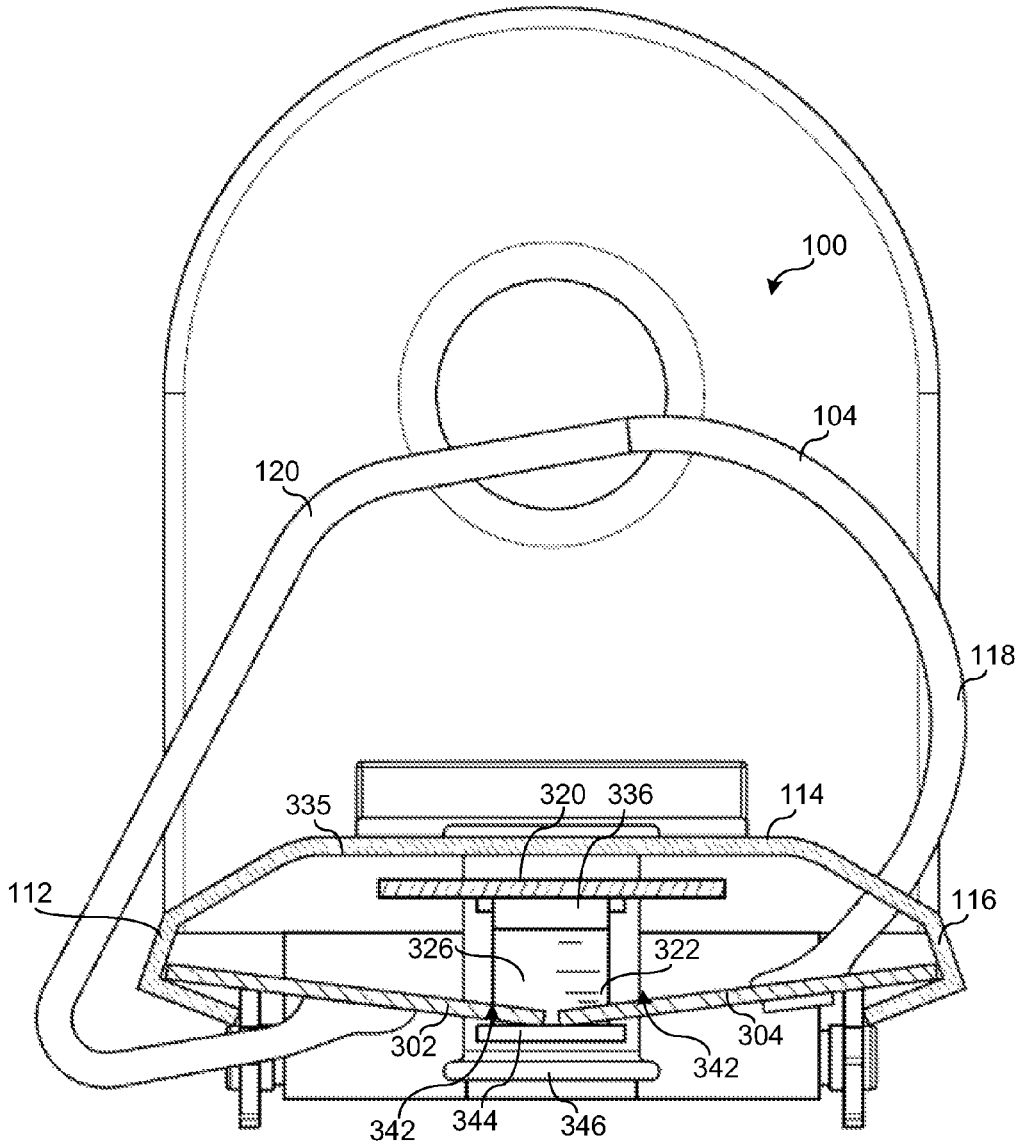
Figure 6:
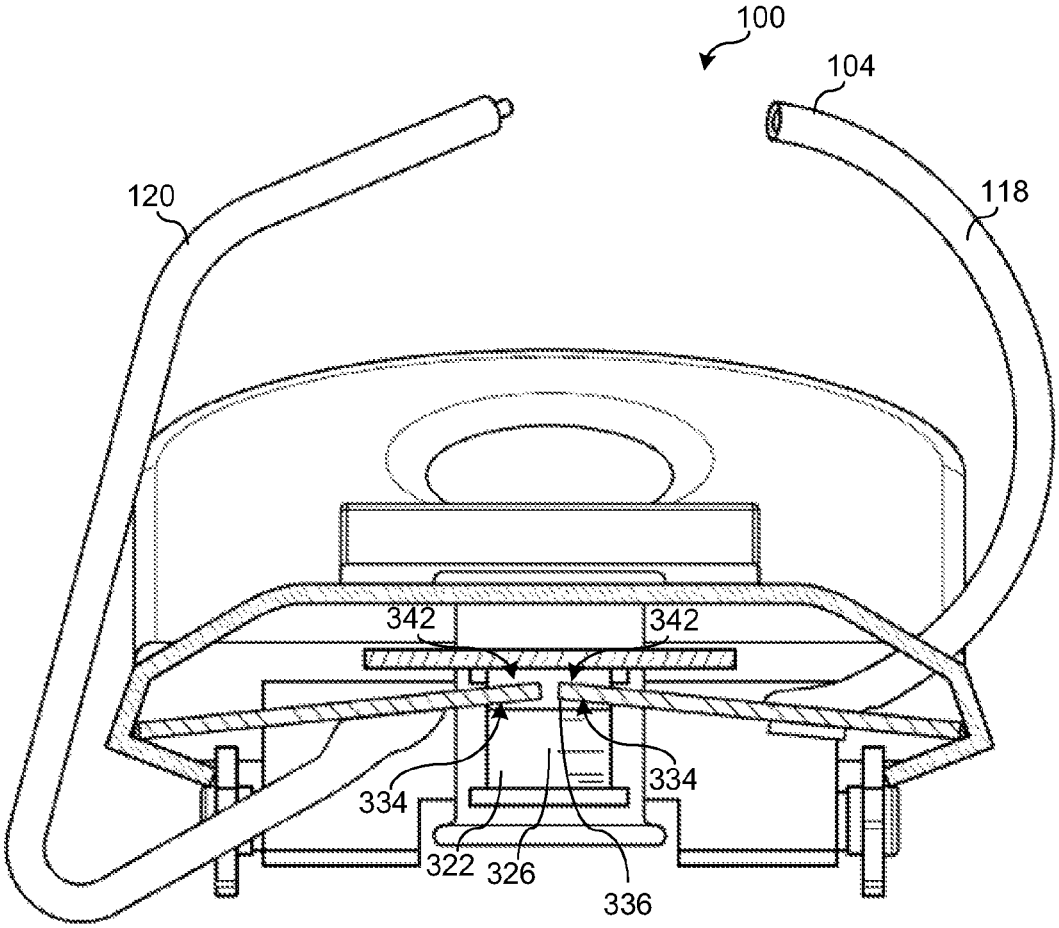

FIGS. 5 and 6 depict cross-sectional views of the example binder 100. FIG. 5 depicts the associated closure members 104 in the closed position and FIG. 6 depicts the associated closure members 104 in the open position. As depicted in FIG. 5, when the associated closure members 104 are in the closed position, the control element 322 is at least partially positioned between the interior surface 335 of the housing 102 and the carrier rails 302 and 304. Specifically, the control element 322 is positioned adjacent the surfaces 342 of the carrier rails 302 and 304 substantially preventing the carrier rails 302 and 304 from moving to the open position. Thus, the control element 322 secures the carrier rails 302 and 304 and the associated closure members 104 in the closed position.

As depicted in FIG. 6, the control element 322 is at least partially positioned over the surfaces 334. Specifically, in some examples, the step 336 is positioned over the surfaces 334 preventing the carrier rails 302 and 304 from moving to the closed position. Thus, the control element 322 secures the carrier rails 302 and 304 and the associated closure members 104 in the open position. However, in other examples, an interaction between the beak 321 of the lever assembly 106 and the carrier rails 302 and 304 may secure the associated closure members 104 in the open and/or closed positions and, thus, the control surfaces 326 and/or 328 may be different and/or may not include the step 336.

Figures 7, 8:
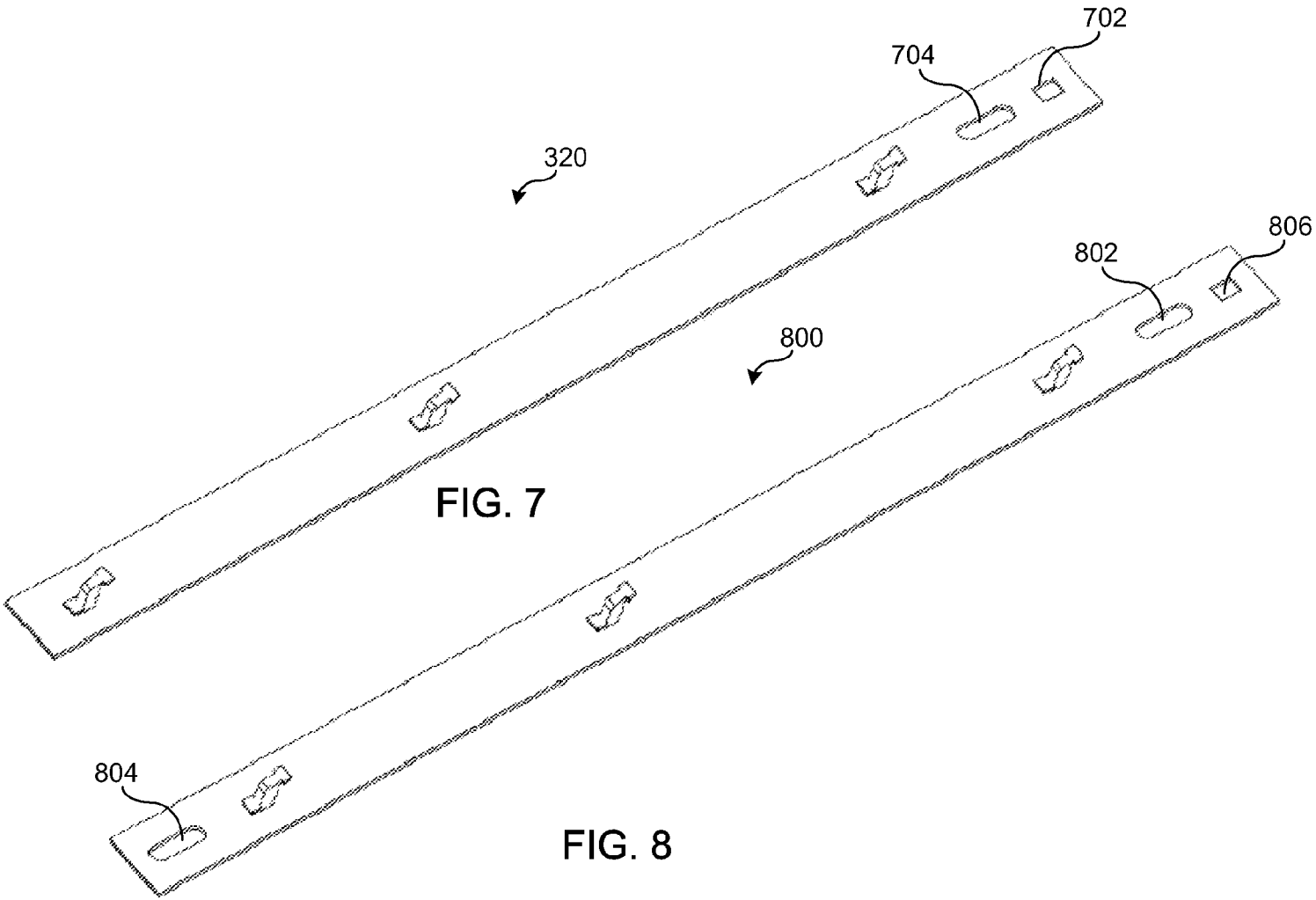
FIG. 7 depicts an example slider that may be used in connection with the examples described herein.
FIG. 8 depicts another example slider that may be used in connection with the examples described herein.

FIG. 8 depicts an alternative example slider 800 having a first slot 802 and a second slot 804. The slider 800 may be referred to as a push rod, a travel bar, a movable member, a carrier, a traveler, etc. and may have any other suitable shape and/or structure. The posts 346 of the housing 102 are to extend through the first and second slots 802 and 804 to at least partially guide the movement of the slider 800. The slider 800 additionally defines an aperture 806 to enable the slider 800 to be operatively coupled to the lever assembly 106, for example. The interaction between the lever assembly 106 and the aperture 806 enables the lever assembly 106 to move the slider 800, for example.

Figure 9:
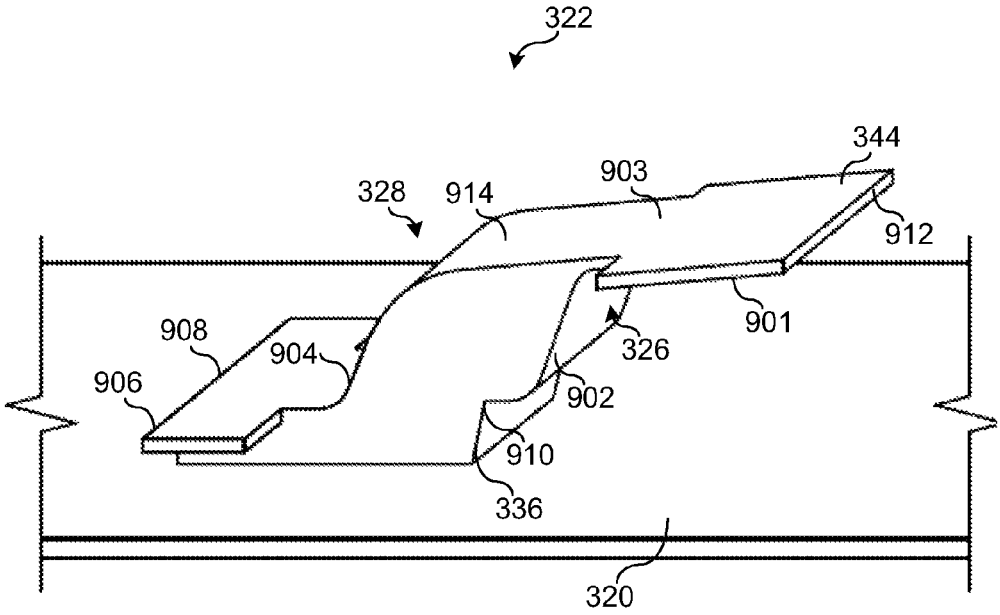
FIG. 9 depicts a detailed view of an example control element used in connection with the examples described herein.

FIG. 9 depicts a detailed view of one of the example control elements 322. The example control element 322 includes the first control surface 326 and the second control surface 328.

In this example, the first control surface 326 includes the extension 344, a tapered surface 901, a curved surface 902 and the step 336; however, in other examples, the first control surface 326 may be different. For example, the curved surface 902 may have a different curvature(s), may be sloped, the extension 344 may have a different width and/or the first control surface 326 may not be provided with the step 336, the extension 344, etc. The curved surface 902 may be configured to transition the carrier rails 302 and 304 between the closed position and the open position as the slider 320 is moved from the second position to the first position, for example. The extension 344 and/or the tapered surface 901 may be configured to enable the control element 322 to engage the carrier rails 302 and/or 304 and control the transition of the carrier rails 302 and/or 304 as the slider 320 is being moved relative thereto. In some examples, the extension 344 may be configured to enable the control element 322 to be substantially aligned and/or prevent jamming etc. as the slider 320 moves the control elements 322 to open and/or close the binder 100, for example.

In this example, the second control surface 328 includes a tapered surface 903, a curved surface 904 and an extension 906 having a tapered surface; however, in other examples, the second control surface 328 may be different. For example, the curved surface 904 may have a different curvature(s), may be sloped, the extension 906 may have a different width, and/or the second control surface 328 may not be provided with the extension 906, etc. The curved surface 904 may be configured to transition the carrier rails 302 and 304 between the open position and the closed position as the slider 320 is moved from the first position to the second position, for example. The extension 906 may be configured to enable the control element 322 to be substantially aligned and/or prevent jamming etc. as the slider 320 moves the control elements 322 to open and/or close the binder 100.

When the binder apparatus 100 is positioned in the open position, the step 336 may be positioned over the surfaces 334 and the extension 906 is to be positioned between the inner surface 335 of the housing 102 and the surfaces 342 of the carrier rails 302 and 302. Thus, an end 908 of the extension 906 and a surface 910 of the step 336 may be at different heights relative to the slider 320 enabling the control element 322 to be easily transitioned between different positions. When the binder apparatus 100 is positioned in the closed position, the tapered surface 903 is to engage the surface 342 of the carrier rails 302 and 304 and the extension 344 is to be positioned over or above the surfaces 334 of the carrier rails 302 and 304. Thus, an end 912 of the extension 344 and a portion 914 of the tapered surface 903 engaging the surface 342 of the carrier rails 302 and 304 may be at different heights relative to the slider 320 enabling the control element 322 to be easily transitioned between different positions.

Figure 10:
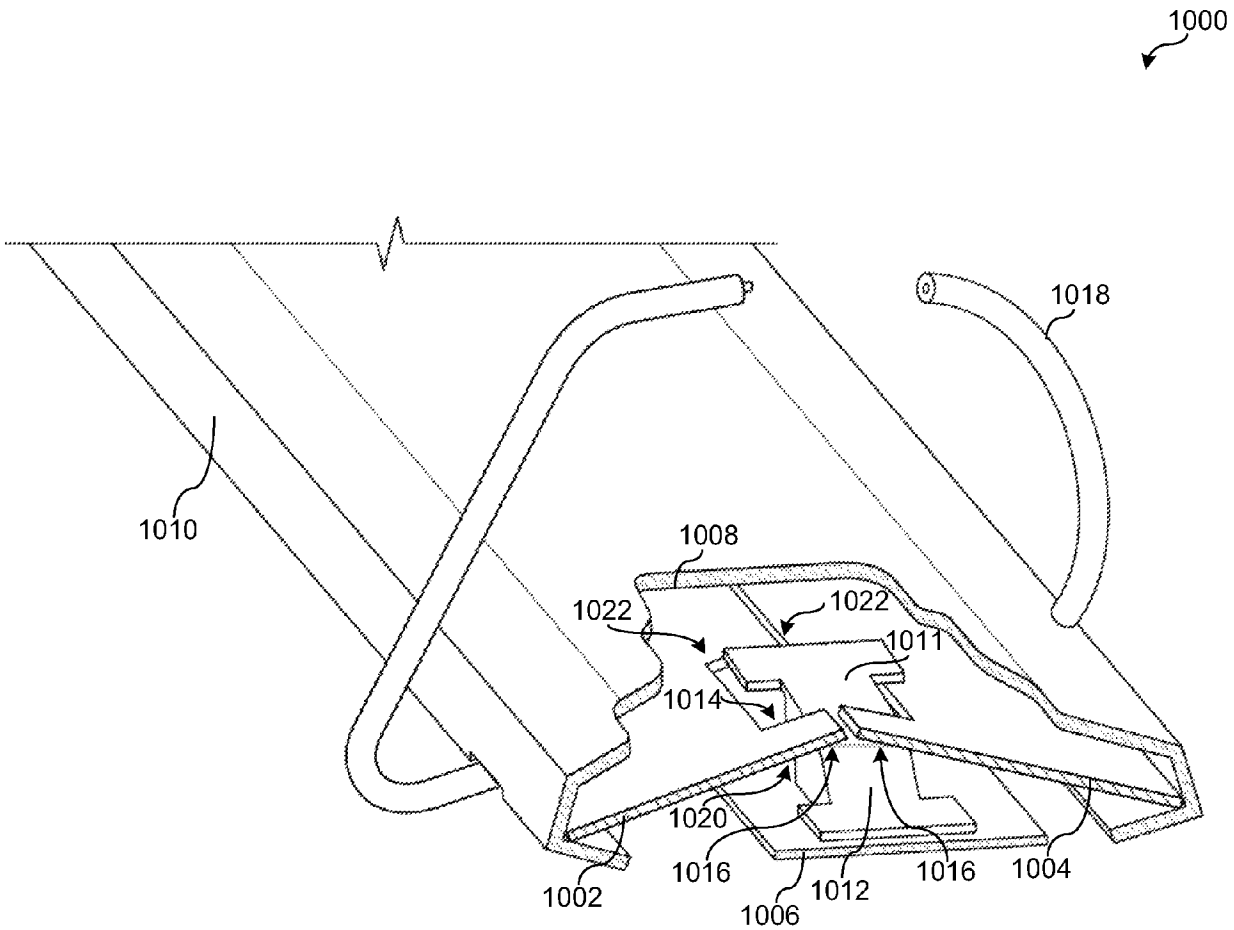
FIG. 10 depicts another example binder apparatus.

FIG. 10 depicts a portion of another example binder apparatus 1000. In contrast to the examples described above, the example binder 1000 includes first and second carrier rails 1002 and 1004 positioned between a slider 1006 and an interior or inner surface 1008 of a housing 1010. Thus, control elements 1011 of the slider 1006 extend toward the interior surface 1008. The example binder 1000 may include any number of control elements (e.g., 1, 2, 3, 4, etc.) that may be evenly or unevenly spaced along the slider 1006.

The control elements 1011 include a first control surface 1012 and a second control surface 1014 that are to urge, transition and/or secure the carrier rails 1002 and 1004 toward and/or in the open and/or closed positions. In some examples, the first control surface 1012 is to engage respective surfaces and/or edges 1016 of the carrier rails 1002 and 1004 to secure associated closure members 1018 in the open position when the slider 1006 is in the first position. The respective surfaces 1016 may face away from the interior surface 1008. In some examples, the second control surface 1014 defines a step 1020 to be positioned over respective surfaces and/or edges 1022 of the carrier rails 1002 and 1004 to secure the associated closure members 1018 in the closed position when the slider 1006 is in the second position. The respective surfaces 1022 may face toward the interior surface 1008.

To couple the slider 1006 to the binder 1000, the slider 1006 may define one or more slots through which posts of the housing 1010 extend.

Figure 11:
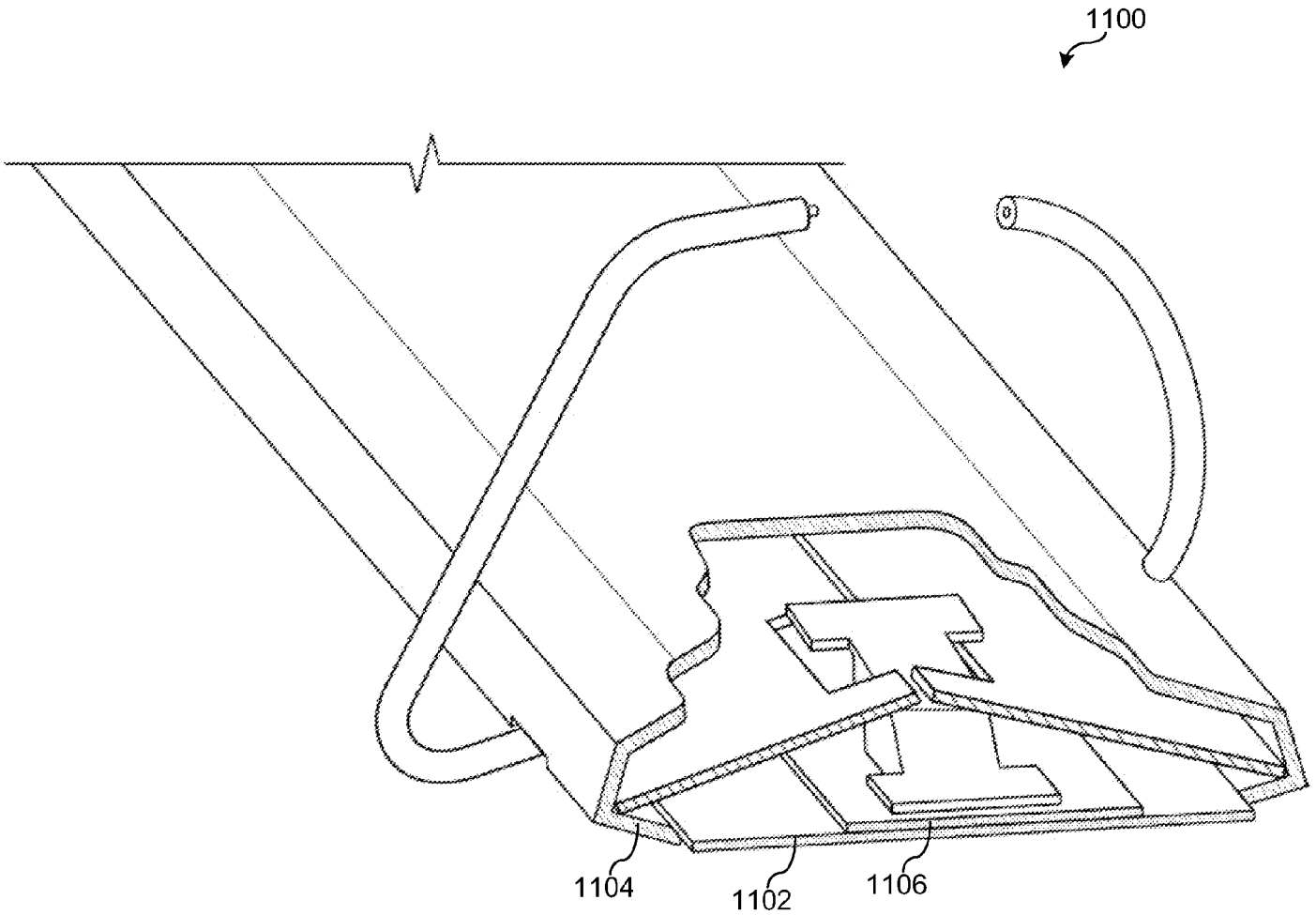
FIG. 11 depicts another example binder apparatus.

FIG. 11 depicts an example binder apparatus 1100 that is similar to the example binder 1000 of FIG. 10. However, in contrast, the example binder 1100 includes a plate 1102 coupled to a housing 1104. The plate 1102 enables a slider 1106 to be secured within the binder 1100 without the slider 1106 defining the slots through which the posts of the housing 1104 extend.

Figure 12:
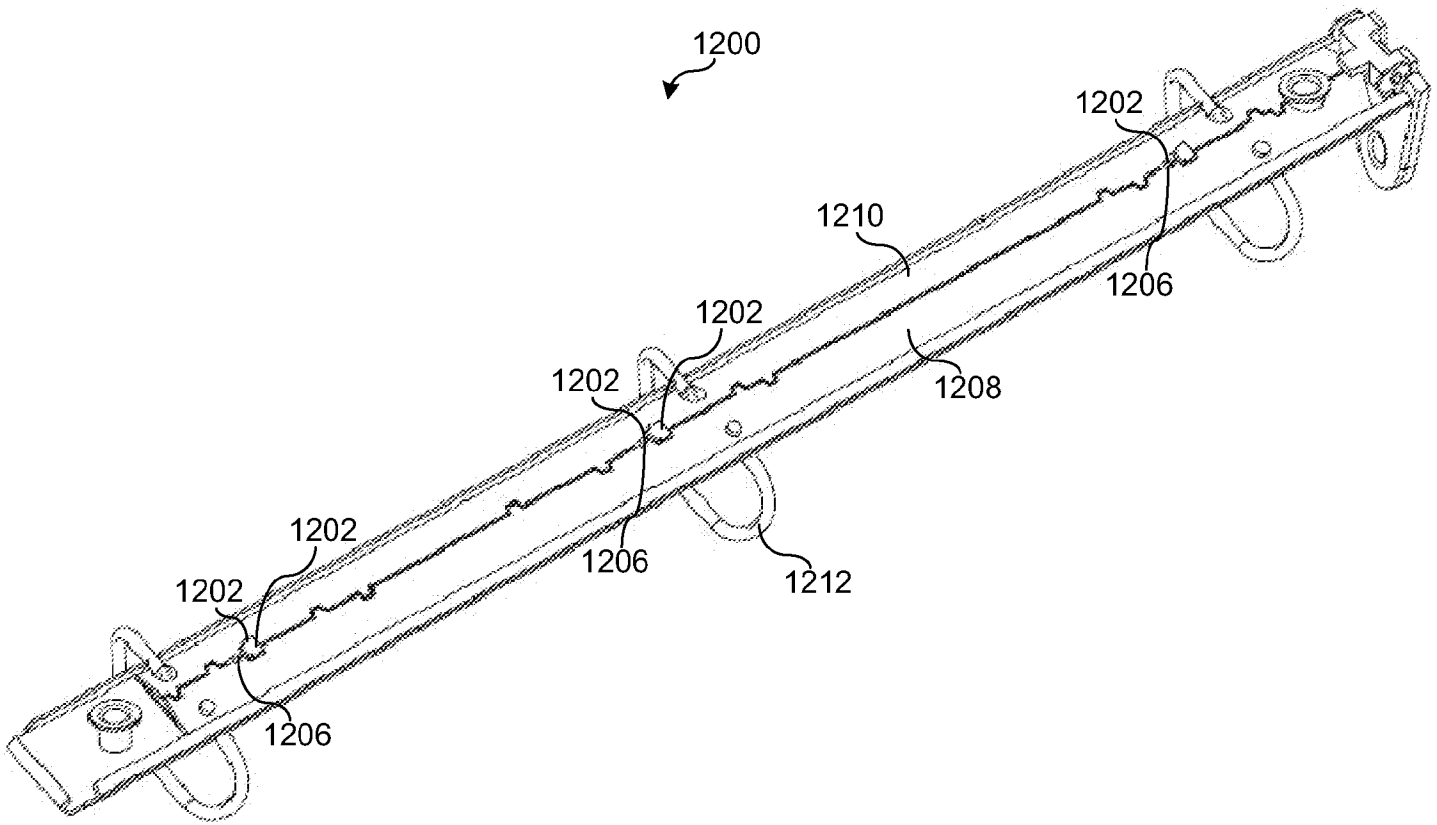
FIG. 12 depicts an example binder apparatus.

FIG. 12 depicts an example binder apparatus 1200 that is similar to the example binder apparatus 100. However, in contrast, control elements 1202 of the binder 1202 include bumps or nubs 1204 that are received by apertures 1206 of carrier rails 1208 and/or 1210. Thus, in this example, when the control elements 1202 are positioned in the closed position, the nubs 1204 are received in the apertures 1206 to further secure closure members 1212, the carrier rails 1208 and/or 1210 and/or the control elements 1202 in the closed position. Additionally or alternatively, the control elements 1202 may include a bumps or nubs that are received by apertures of the carrier rails 1208 and/or 1210 when the control elements 1202 are positioned in the open position. For example, the additional or alternative nubs may extend from a surface of the step 336.

Figure 13:
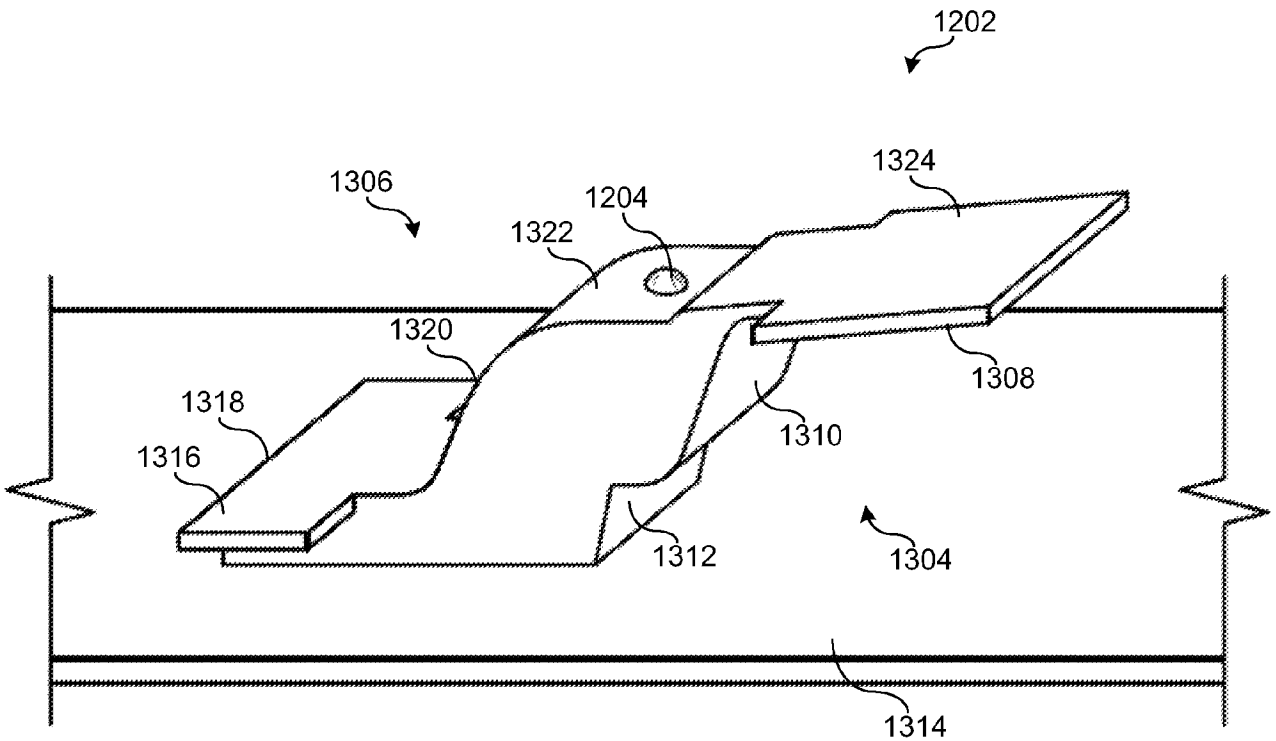
FIGS. 13 and 14 depict different example control elements that can be used in connection with the examples described herein.

FIG. 13 depicts a detailed view of the example control element 1202. The control element 1202 includes a first control surface 1304 and a second control surface 1306 that interact with the carrier rails 1208 and 1210 to transition and/or secure the carrier rails 1208 and 1210 in either the open or closed position. The first control surface 1304 includes a tapered surface 1308 that may be configured to extend over the carrier rails 1208 and 1210 when the carrier rails 1208 and 1208 are positioned in the closed position. Additionally, the first control surface 1306 may include a curved surface 1310 and a step 1312. The curved surface 1310 may be configured to transition the carrier rails 1208 and 1210 between the open position and the closed position as a slider 1314 from which the control element 1202 extends is moved. Once positioned in the open position, the step 1312 may engage surfaces of the carrier rails 1208 and 1210 to secure the carrier rails 1208 and 1210 in the open position. In some examples, the step 1312 may include a bump or nub that is received by the carrier rails 1208 and 1210 when the carrier rails 1208 and 1208 are in the open position to further secure the carrier rails 1208 and 1210 in the open position, for example.

The second control surface 1306 includes an extension 1316 having an end 1318 configured to be on a different side of the carrier rails 1208 and 1210 than the step 1312 when the step 1312 engages the carrier rails 1208 and 1210 to secure the carrier rails 1208 and 1210 in the open position, for example. Additionally, the second control surface 1306 includes a curved surface 1320, a first tapered or flat surface 1322 having the nub 1204 and a second tapered surface 1324.

Figure 14:
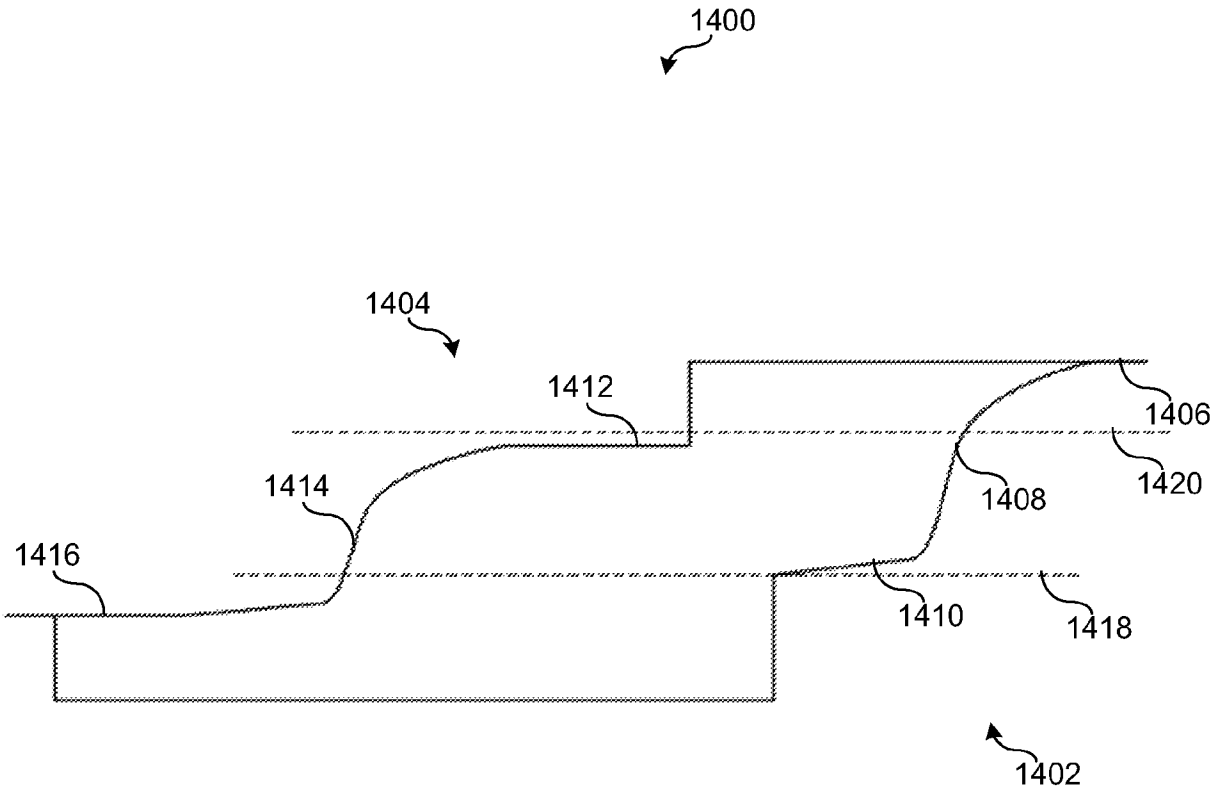

FIG. 14 depicts an example control element 1400 that may be used in connection with the example described herein. The control element 1400 includes a first control surface 1402 and a second control surface 1404 that interact with carrier rails to transition and/or secure the carrier rails in either the open or closed position.

The first control surface 1402 includes a protruding surface 1406 that protrudes above the carrier rails to enable the carrier rails to be transitioned downward when the control element 1400 faces an interior of a binding housing. The first control surface 1402 additionally includes a transitioning surface 1408 that transitions the carrier rails between the open and/or closed positions and a securing surface 1410 that may secure and/or lock the carrier rails downward in, for example, the closed position when the control element 1400 faces an interior of a binder housing.

The second control surface 1404 includes a securing surface 1412 that may secure and/or lock the carrier rails upward in, for example, the open position when the control element 1400 faces an interior of a binder housing. The second control surface 1404 additionally includes a transitioning surface 1414 that transitions the carrier rails between the open and/or closed positions and a protruding surface 1416 that protrudes beneath the carrier rails to enable the carrier rails to be transitioned upward when the control element faces an interior of a binding housing. A first line 1418 represents an approximate bottommost or first position of the carrier rails and a second line 1420 represents an approximate topmost or second position of the carrier rails.

Furthermore, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A binder apparatus, comprising a housing;

a first carrier rail having a first longitudinal edge and a second longitudinal edge, the first carrier rail defining a notch adjacent the second longitudinal edge, the housing biasing the first carrier rail by engaging the first longitudinal edge;

a second carrier rail having a third longitudinal edge and a fourth longitudinal edge, the housing biasing the second carrier rail by engaging the third longitudinal edge, the second longitudinal edge hingably engaging the fourth longitudinal edge, the notch defining an opening having a first edge and a second edge opposite the first edge;

a slider having a control element extending therefrom, the control element comprising a first control surface and a second control surface, the first control surface comprising a curved surface to engage the first edge to transition the first and second carrier rails toward an open position, the first control surface comprising a step between the curved surface and the slider, the step to secure the first and second carrier rails in the open position, the second control surface to engage the second edge to urge the first and second carrier rails to and secure the first and second carrier rails in a closed position; and a lever operatively coupled to the slider to move the slider between a first position and a second position, in the first position, the first control surface to engage the first edge to secure the first and second carrier rails in the open position, in the second position, the second control surface to engage the second edge to secure the first and second carrier rails in the closed position.

2. The binder apparatus of claim 1, wherein the control element is to extend away from an inner surface of the housing.

3. The binder apparatus of claim 2, the first control surface comprising an extension that, in the second position, at least partially extends over respective surfaces of the carrier rails adjacent the first edge to substantially ensure alignment of the control element with the carrier rails as the lever is moved from the second position to the first position.

4. The binder apparatus of claim 2, wherein the second control surface, in the second position, is to at least partially engage respective surfaces of the carrier rails adjacent the second edge to secure the first and second carrier rails in the closed position, the respective surfaces facing toward the inner surface of the housing.

5. The binder apparatus of claim 2, the second control surface comprising a curved surface to transition the carrier rails from the open position to the closed position as the slider is moved from the first position to the second position.

6. The binder apparatus of claim 1, the slider defining a slot through which a post of the housing extends, the interaction between the slot and the post at least partially guides the movement of the slider between the first position and the second position.

7. The binder apparatus of claim 1, wherein the control element is to extend toward an inner surface of the housing.

8. The binder apparatus of claim 7, the second control surface comprising a step to be, in the second position, positioned adjacent respective surfaces of the carrier rails adjacent the second edge to secure the first and second carrier rails in the closed position, the respective surfaces facing toward the inner surface of the housing.

9. The binder apparatus of claim 7, the first control surface comprising a curved surface to transition the carrier rails from the closed position to the open position as the slider is moved from the second position to the first position.

10. The binder apparatus of claim 7, wherein the first control surface, in the first position, is to at least partially engage respective surfaces of the carrier rails adjacent the first edge to secure the first and second carrier rails in the open position, the respective surfaces facing away from the inner surface of the housing.

11. The binder apparatus of claim 7, further comprising a plate coupled to the housing, the slider positioned between the inner surface of the housing and the plate.

12. The binder apparatus of claim 1, wherein the control element extends substantially perpendicularly from the slider.

13. The binder apparatus of claim 1, further comprising a plurality of control elements extending from the slider.

14. The binder apparatus of claim 1, further comprising a plurality of associated closure members that interact to enable objects to be retained, at least one of the plurality of associated closure members is coupled to the first carrier rail and at least another one of the plurality of associated closure members is coupled to the second carrier rail.

15. The binder apparatus of claim 14, further comprising a plurality of control elements extending from the slider, one of the plurality of control elements positioned adjacent to each of the plurality of associated closure members.

16. A binder apparatus, comprising a housing;

a first carrier rail having a first longitudinal edge and a second longitudinal edge, the first carrier rail defining a notch adjacent the second longitudinal edge, the housing biasing the first carrier rail by engaging the first longitudinal edge;

a second carrier rail having a third longitudinal edge and a fourth longitudinal edge, the housing biasing the second carrier rail by engaging the third longitudinal edge, the second longitudinal edge hingably engaging the fourth longitudinal edge, the notch defining an opening having a first edge and a second edge opposite the first edge; and a slider having a control element extending therefrom, the control element comprising a first control surface and a second control surface, the first control surface comprising a step between a curved surface of the first control surface and the slider, the curved surface to engage the first edge to transition the first and second carrier rails to an open position, the second control surface to engage the second edge to urge the first and second carrier rails to a closed position.

17. A binder apparatus, comprising a housing;

a first carrier rail having a first longitudinal edge and a second longitudinal edge, the first carrier rail defining a notch adjacent the second longitudinal edge, the housing biasing the first carrier rail by engaging the first longitudinal edge;

a second carrier rail having a third longitudinal edge and a fourth longitudinal edge, the housing biasing the second carrier rail by engaging the third longitudinal edge, the second longitudinal edge hingably engaging the fourth longitudinal edge, the notch defining an opening adjacent a first surface and a second surface opposite the first surface;

a slider having a control element extending therefrom, the control element comprising a first control surface and a second control surface, the first control surface comprising a step between a curved surface of the first control surface and the slider, the step to engage the first surface to secure the first and second carrier rails in an open position, the second control surface to engage the second surface to secure the first and second carrier rails in a closed position; and a lever operatively coupled to the slider to move the slider between a first position and a second position, in the first position, the first control surface to engage the first surface to secure the first and second carrier rails in the open position, in the second position, the second control surface to engage the second surface to secure the first and second carrier rails in the closed position.

18. The binder apparatus of claim 17, wherein the first surface and the second surface comprise first and second edges defining the opening.

* * * * *